US008925357B2

(12) United States Patent
Moon et al.

(10) Patent No.: US 8,925,357 B2
(45) Date of Patent: Jan. 6, 2015

(54) CLOTHES TREATING APPARATUS

(75) Inventors: Jung Wook Moon, Changwon-si (KR); Dae Yun Park, Changwon-si (KR); Sog Kie Hong, Changwon-si (KR); Jong Seok Kim, Changwon-si (KR); Seung Gyu Ryu, Changwon-si (KR); Hye Yong Park, Changwon-si (KR); Chang Gyu Choi, Changwon-si (KR); Dong Won Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1375 days.

(21) Appl. No.: 12/309,885

(22) PCT Filed: Aug. 4, 2008

(86) PCT No.: PCT/KR2008/004504

§ 371 (c)(1),
(2), (4) Date: Sep. 14, 2010

(87) PCT Pub. No.: WO2009/020313

PCT Pub. Date: Feb. 12, 2009

(65) Prior Publication Data

US 2011/0005276 A1 Jan. 13, 2011

(30) Foreign Application Priority Data

Aug. 3, 2007 (KR) ..... 10-2007-0078119

(51) Int. Cl.

| | |
|---|---|
| ***D06F 37/00*** | (2006.01) |
| ***D06F 58/10*** | (2006.01) |
| ***D06F 58/20*** | (2006.01) |
| ***D06F 73/02*** | (2006.01) |

(52) U.S. Cl.

CPC ..... *D06F 58/10* (2013.01); *D06F 58/20* (2013.01); *D06F 58/203* (2013.01); *D06F 73/02* (2013.01)

USPC ..... 68/208; 68/6

(58) Field of Classification Search

USPC ..... 68/6, 208

See application file for complete search history.

(56) References Cited

U.S. PATENT DOCUMENTS

| | | | | |
|---|---|---|---|---|
| 3,869,815 | A * | 3/1975 | Bullock | 38/77.6 |
| 5,094,020 | A | 3/1992 | Wingfield et al. | |
| 5,152,077 | A | 10/1992 | Liang | |
| 5,305,484 | A * | 4/1994 | Fitzpatrick et al. | 8/149.3 |
| 5,546,678 | A | 8/1996 | Dhaemers | |
| 6,018,885 | A | 2/2000 | Hill | |
| 6,425,192 | B2 | 7/2002 | Arrieta et al. | |

FOREIGN PATENT DOCUMENTS

| | | |
|---|---|---|
| EP | 0 324 589 | 7/1989 |
| JP | 08-047595 A | 2/1996 |
| JP | 10-080331 A | 3/1998 |

* cited by examiner

*Primary Examiner* — Alex Noguerola

(74) *Attorney, Agent, or Firm* — McKenna Long & Aldridge LLP

(57) ABSTRACT

The present invention relates to clothes treating apparatus. The clothes treating apparatus includes a housing having a holding space for holding clothes, an air supply unit for generating dry air and supplying the dry air to the holding space, a moisture supply unit for supplying moisture to the holding space, and a water supply unit for supplying water to the moisture supply unit, and a drain unit for collecting condensed water from the air supply unit, wherein the water supply unit and the drain unit are provided separate from each other.

17 Claims, 5 Drawing Sheets

CLOTHES TREATING APPARATUS

This application is a national stage entry of International Patent Application No. PCT/KR2008/004504 filed Aug. 4, 2008, and claims the benefit of Korean Patent Application No. 10-2007-0078119 filed Aug. 3, 2007, both of which are hereby incorporated by reference, in their entireties, for all purposes as if fully set forth herein.

The present invention relates to clothes treating apparatuses. More specifically, the present invention relates to a clothes treating apparatus of which structure simplified for easy maintenance.

BACKGROUND ART

In addition to washing machines which wash clothes, there are many kinds of clothes treating apparatuses that are currently used. For an example, developed recently are drum type dryers for drying washed clothes, housing type dryers for drying the clothes while the clothes are hung up, and refreshers for refreshing clothes by supplying hot air to the clothes.

In these refresher or dryer-type clothes treating apparatuses the air is heated with a heater and supplied to the clothes. Various types of heaters are available, such as gas heaters, which burn gas to heat air, and electric heaters which heat the air with electric resistance. Currently, electric heaters are used mostly, as they are convenient to install, and have simple structure.

There are certain drawbacks to using electrical heaters in clothes drying apparatuses. If the air is heated with the electric heater, air having a dangerously high temperature may be transferred directly to the clothes, which may damage the clothes or worse, cause a fire in the clothes treating apparatus. Moreover, electric heaters consume large quantities of electricity when used to heat the air to a desired temperature, therefore, much maintenance expense is required.

SUMMARY OF THE INVENTION

To solve the above problems, an object of the present invention is to provide a clothes treating apparatus which has a simple structure and can reduce consumption of electric energy.

Another object of the present invention is to provide a clothes treating apparatus of which structure is simplified for easy maintenance thereof.

In accordance with one aspect of the present invention, the aforementioned objects and other advantages may be achieved by a clothes treating apparatus that includes a housing having a holding space for holding clothes, an air supply unit for generating dry air and supplying the dry air to the holding space, a moisture supply unit for supplying moisture to the holding space, and a water supply unit for supplying water to the moisture supply unit, and a drain unit for collecting condensed water from the air supply unit, wherein the water supply unit and the drain unit are provided separate from each other.

In accordance with another aspect of the present invention, the aforementioned objects and other advantages may be achieved by a clothes treating apparatus that includes a housing having a holding space for holding clothes, an air supply unit for generating dry air and supplying the dry air to the holding space, a moisture supply unit for supplying moisture to the holding space, and a storage module having a plurality of chambers each for holding either a water supply unit for supplying water to the moisture supply unit, or a drain unit for collecting condensed water from the air supply unit.

In accordance with yet another aspect of the present invention, the aforementioned objects and other advantages may be achieved by a clothes treating apparatus that includes a housing having a holding space for holding clothes, an air supply unit for generating dry air and supplying the dry air to the holding space, a moisture supply unit for supplying moisture to the holding space, and at least one storage module for holding a water supply unit for supplying water to the moisture supply unit, and a drain unit for collecting condensed water from the air supply unit, wherein flow passages of the water supply unit and the drain unit are formed through the storage module.

The present invention has following advantageous effects.

The heat pump provided to the clothes treating apparatus permits to refresh clothes while reducing an electric energy consumption significantly in comparison to the related art.

Moreover, the provision of the drain unit for collecting condensed water from the heat pump and the water supply unit for supplying water to the moisture supply unit to one storage module permits very easy maintenance.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

DETAILED DESCRIPTION

Reference will now be made in detail to the specific embodiments of the present invention, examples of which are illustrated in the accompanying drawings. Wherever possible, the same reference numbers will be used throughout the drawings to refer to the same or like parts.

Figure 1:
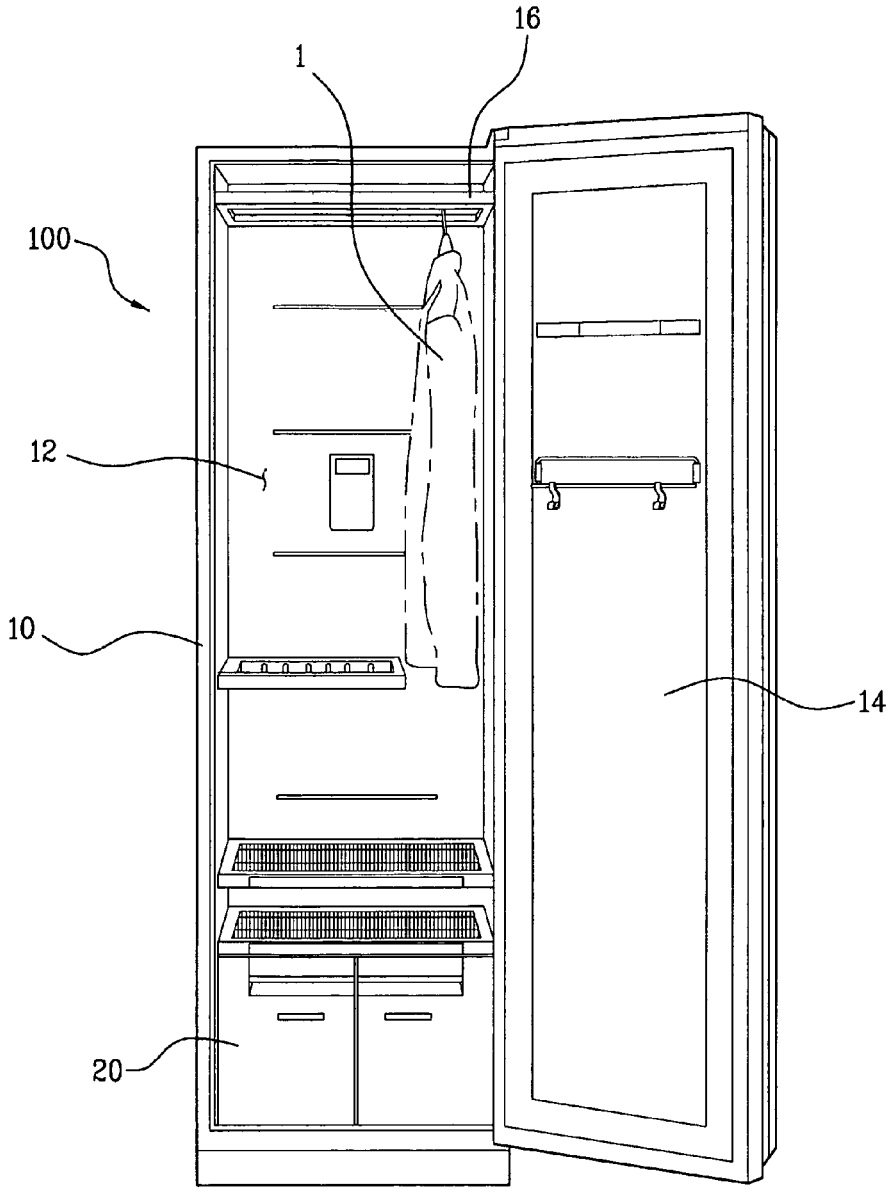
FIG. 1 illustrates a front view of a clothes treating apparatus in accordance with a preferred embodiment of the present invention.

FIG. 1 illustrates a front view of a clothes treating apparatus in accordance with a preferred embodiment of the present invention. Though the specification describes a refresher which refreshes the clothes and supplies hot air as the clothes treating apparatus, the clothes treating apparatus of the present invention is not limited to this. The clothes treating apparatus of the present invention is applicable to other clothes treating apparatus which can have a heat pump provided thereto.

Referring to FIG. 1, the clothes treating apparatus 100 includes a cabinet 10 having an accommodating space 12 for holding and accommodating clothes therein, an air supply unit 22 (see FIG. 2) for condensing moisture in air to supply dry air to the accommodating space 12, a moisture supply unit 30 (see FIG. 2) for selective supply of moisture to the accommodating space 12, a water supply unit for supplying water to the moisture supply unit 30, and a drain unit for holding condensed water removed at the air supply unit.

The cabinet 10 has various units described later mounted thereto, and the accommodating space 12 formed therein for holding clothes. The accommodating space 12 may be in communication with an outside thereof by a door 14, selectively. The accommodating space 12 has various kinds of supporters for hanging and supporting the clothes. Since the supporters for supporting the clothes, i.e. hanging rods, shelves, etc., are known widely to those skilled in the art, detailed description of the supporters will be omitted.

In the cabinet 10, there may a mechanism compartment 20 having the air supply unit 22 and the moisture supply unit 30 for supplying dry air and moisture to the accommodating space 12 mounted therein. Preferably, the mechanism compartment 20 may be at a lower portion of the accommodating space 12, with the air supply unit 22 and the moisture supply unit 30 mounted therein. The mechanism compartment 20 is positioned at the lower portion for upward supply of the air and the moisture because the air and the moisture, which are preferably hot air and steam, have a tendency to rise upward.

Figure 2:
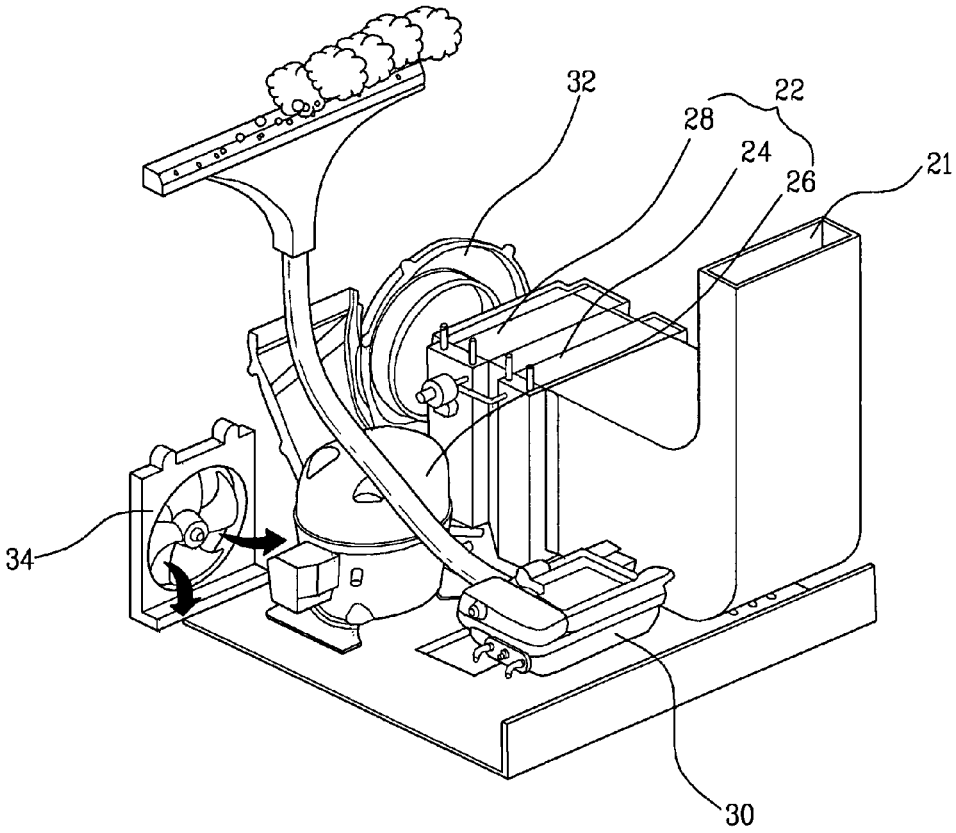
FIG. 2 illustrates a perspective view of the machinery room in FIG. 1.

FIG. 2 illustrates a perspective view of the mechanism compartment 20, schematically. In FIG. 2, only elements of the air supply unit 22 and the moisture supply unit 30 are shown for convenience of description, while no pipelines connected between the elements are shown.

Referring to FIG. 2, mounted in the mechanism compartment 20, there are the air supply unit 22 for removing moisture from the air for supplying dry air to the accommodating space 12 (see FIG. 1) and the moisture supply unit 30 for supplying moisture to the accommodating space 12.

The embodiment employs a heat pump 22 as the air supply unit for supplying the dry air to the accommodating space 12. The heat pump 22 is similar to a heat pump used in an air conditioner. That is, the heat pump 22 has an evaporator 24, a compressor 26, a condenser 28, and an expansion valve (not shown), through which refrigerant circulates, for removing the moisture from the air and heating the air.

That is, the refrigerant absorbs latent heat from environmental air as the refrigerant evaporates at the evaporator 24, to cool down the air to condense and remove the moisture from the air. In this case, it is preferable that the drain unit 60, 160, or 260 is provided for collecting the condensed water. That is, the condensed water from the evaporator 24 may be collected at a holding unit under the evaporator 24, and supplied therefrom to the drain unit by a pump or the like, and held therein. It is preferable that the drain unit is detachably mounted to the cabinet 10, such that the user can detach only the drain unit and throws away the condensed water. The drain unit will be described in detail below.

The refrigerant heats the environmental air as the refrigerant that has passed through the compressor 26 then passes through the condenser 28, where the refrigerant discharges the latent heat to environmental air. Therefore, because the evaporator 24 and the condenser 28 serve as heat exchangers, the air introduced to the mechanism compartment 20, not only has the moisture therein removed at the evaporator 24 and the condenser 28, but also is heated to a preset temperature before it is supplied to the accommodating space 12.

The air heated by the heat pump 22 thus can have the moisture therein removed therefrom without using a separate dehumidifier. Therefore, the air supplied to the accommodating space 12 by the heat pump 22 is heated dry air. The heated dry air supplied by the heat pump 22 of the exemplary embodiment can supply dehumidified air without a dehumidifier, thus the heated dry air can dry and refresh clothes, easily.

In detail, it is preferable that the mechanism compartment 20 has an air inlet 21 in a front of an upper portion for introducing air from the accommodating space 12 to the mechanism compartment 20, and a duct 29, connecting the air inlet 21, the evaporator 24, the condenser 28, and the fan 32, forms an air flow passage. The air introduced to the mechanism compartment 20 through the duct 29 via the air inlet 21 has the moisture removed therefrom and is heated at the heat pump 22, and is supplied to the accommodating space 12 again by the fan 12.

Though not shown, the air inlet 21 may have a filter provided thereto. By providing the filter to the air inlet 21, particles contained in the air being introduced to the mechanism compartment 20 from the accommodating space 12 can be filtered out to supply clean fresh air to the accommodating space 12.

In the meantime, the mechanism compartment 20 has the moisture supply unit 30 provided therein for supplying moisture to the accommodating space 12. The moisture supply unit 30 for supplying the moisture to the accommodating space 12 to refresh the clothes, may be a steam generator, preferably.

If the moisture supply unit 30 is a steam generator, steam is supplied to the accommodating space 12 with a steam generator 30. The steam may act to remove wrinkles from the clothes. Furthermore, the steam may provide a sterilizing effect to the clothes due to the high temperature of the steam, as well as a refreshing effect due to inflation of clothing fibers. A time when the steam is sprayed with the steam generator 30 can be varied appropriately, and it is preferable that the steam is sprayed before the heated dry air is supplied via the air supply unit 22 described above. This is because it is preferable that the clothes are dried by supplying the heated dry air after hot steam is sprayed.

The steam generator has a heater (not shown) provided therein for heating water to generate and supply the steam to the accommodating space 12. An external water tap or a container at one side of the cabinet 10 may be used as a water supply unit for supplying water to the steam generator 30. Preferably the container type water supply unit is detachable so that the user detaches the water supply unit from the cabinet 10, fills water in the water supply unit, and mounts the water supply unit to the cabinet 10 again. The water supply unit will be described in detail, later.

The steam is supplied from the steam generator 30 to the accommodating space 12 through a steam hose 36 and a steam nozzle 40. In this case, in order to prevent a steam temperature from dropping while the steam moves along the steam hose 36, or to prevent the steam from condensing, it is preferable that the steam hose 36 is short. Therefore, if the mechanism compartment 20 is at the lower portion of the accommodating space 12, the steam nozzle 40 may be at an upper portion of the mechanism compartment 20, i.e., it is preferable that the steam is supplied through a lower portion of the accommodating space 12.

In a rear portion of the mechanism compartment 20, a circulating fan 34 may be provided. By supplying air from an outside of the mechanism compartment 20 to the mechanism compartment 20, the circulating fan 34 prevents a temperature of the machinery room from rising, excessively.

In the meantime, a clothes treating apparatus in which moisture is supplied to the holding space and furthermore moisture is condensed to remove the moisture from air like the clothes treating apparatus of the embodiment requires a system for supplying water to the moisture supply unit and a system for draining the condensed water from the air supply unit. however, if the system for supplying water to the moisture supply unit is provided to be accessible at an outside of the clothes treating apparatus, for an example, a water tap, or if the condensed water is drained from the air supply unit to the outside of the clothes treating apparatus directly, it is required that the clothes treating apparatus is installed adjacent to the water tap and the drain hole.

According to this, the clothes treating apparatus of the present invention has the drain unit for collecting the condensed water from the air supply unit 22 and the water supply unit for supplying water to the moisture supply unit 30 provided thereto, preferably separate from each other, which will be described in detail with reference to the drawings.

Figure 3:
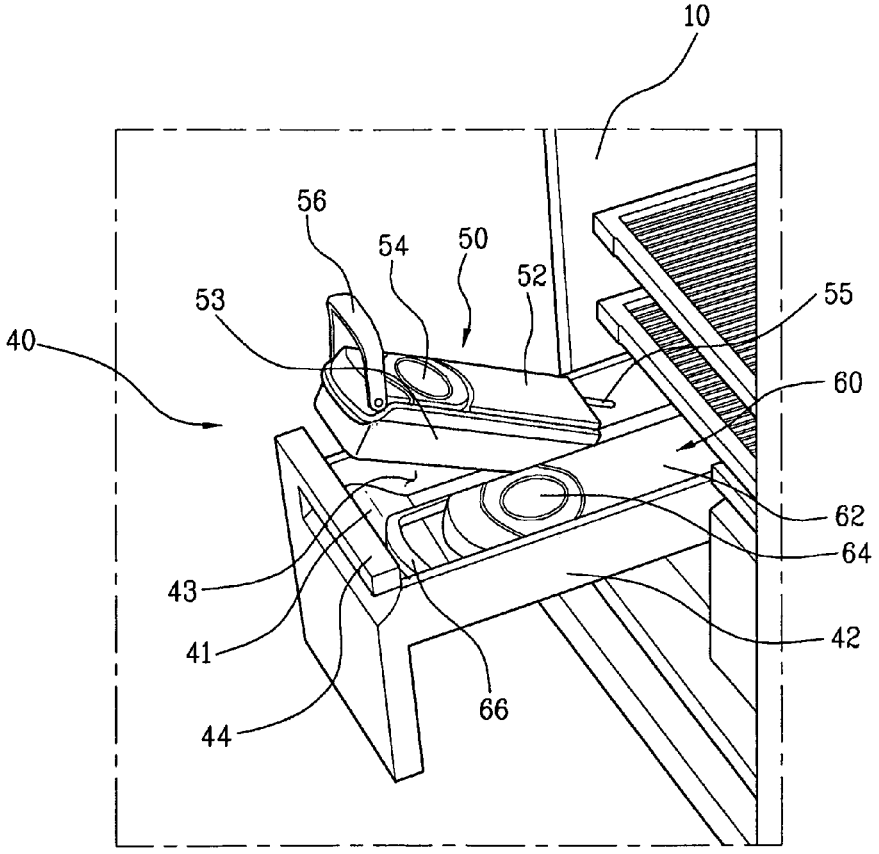
FIG. 3 illustrates a perspective view of the storage module in FIG. 1 in accordance with a first preferred embodiment of the present invention.

FIG. 3 illustrates a perspective view of a state of the water supply unit 50 and the drain unit 60 provided in the clothes treating apparatus in accordance with a first preferred embodiment of the present invention.

Referring to FIG. 3, the water supply unit 50 and the drain unit 60 are provided in the clothes treating apparatus separate from each other, preferably individually. In detail, the water supply unit 50 and the drain unit 60 can be provided to the clothes treating apparatus, detachably. To provide such a system, the water supply unit 50 and the drain unit 60 may be provided to a storage module 40 in the cabinet 10, detachably. The storage module 40 may be provided with a drawer 42 detachably mounted to one side of the cabinet 10, and the water supply unit 50 and the drain unit 60 are placed in the drawer 42.

In detail, referring to FIG. 3, the drawer 42 may be mounted movable forward in a horizontal direction. That is, the drawer 42 may be pushed in the cabinet 10 in a horizontal direction, or pulled out of the cabinet 10 in the horizontal direction. In this case, it is preferable that the drawer 42 is mounted to be pushed in the mechanism compartment 20 at a lower portion of the cabinet 10 because the air supply unit 22 and the moisture supply unit 30 are in the mechanism compartment 20.

If the drawer 42 moves in the horizontal direction, though not shown, it is preferable that a guide member may be provided for guiding the movement of the drawer 42. That is, it is preferable that projections are provided to one of opposite sides of the drawer 42 or an inside of the mechanism compartment 20, and a groove in conformity with the projections are provided to the other one so that the projections move along the grooves.

It is preferable that the drawer 42 has a handle 44 on a front for easy push-in/pull out movement of the drawer 42. By using the handle 44, the user can insert or remove the drawer 42 easily.

The drawer 42 has more than one chamber 43 formed therein for holding the water supply unit 50 and the drain unit 60 therein. Though FIG. 3 illustrates both the water supply unit 50 and the drain unit 60 placed therein in one chamber 43, the present invention is not limited to this, but preferably, two or more than two chambers may be provided for holding the water supply unit 50 and the drain unit 60 independently.

If the water supply unit 50 and the drain unit 60 are placed in the chamber 43, guide means for guiding movement of the water supply unit 50 and the drain unit 60 may be provided. The guide means provides so that the water supply unit 50 and the drain unit 60 are properly and securely seated in the chamber 43. As shown in the drawing, the guide means may be a projection 41 from one side of the chamber 43, preferably, from a bottom of a front side of the chamber 43. That is, when the user places the water supply unit 50 and the drain unit 60 in the chamber 43, the water supply unit 50 and the drain unit 60 are moved within the chamber 43 in accordance with projection 41.

If a plurality of chambers are provided, partitions (not shown) between the chambers can serve as the guide means. That is, by providing the partitions among the chambers, as the water supply unit 50 and the drain unit 60 are in close contact with the partitions, the water supply unit 50 and the drain unit 60 can be made immovable.

FIG. 3 illustrates the water supply unit 50 and the drain unit 60 mounted horizontally, however, the present invention is not limited to this. For an example, the water supply unit 50 and the drain unit 60 may be stacked vertically.

The water supply unit 50 that supplies water to the moisture supply unit 30 has a space therein for holding the water, which includes a lower body 53 and an upper cover 52 detachably coupled to the lower body 53. The upper cover 52 is detachably coupled to the lower body 53, and has a rotatable handle 56 at one side thereof. Accordingly, by using the handle 56, the user can take the water supply unit 50 out of the drawer 42 or seats the water supply unit 50 in the drawer 42. In the meantime, a lid 54 is provided on top of the upper cover 52, so that the water can be supplied into the water supply unit 50 through a water inlet (not shown) after opening the lid 54.

The water may be supplied to the moisture supply unit 30 from the water supply unit 50 through a water outlet 55 in a rear end of the water supply unit 50. That is, if the water supply unit 50 placed in the chamber 43 of the drawer 42 and the drawer 42 is pushed in, the water outlet 55 is connected to a hose connected to the moisture supply unit 30 through the drawer 42 enabling a water supply to the moisture supply unit 30. In this case, the guide means can precisely guide the water outlet 55 of the water supply unit 50 to be connected to the hose through the drawer 42.

The drain unit 60 which collects the condensed water from the air supply unit 22 can also have a structure similar to the water supply unit 50. That is, though not shown, the drain unit 60 may have a lower body and an upper cover 62 defining an interior volume, and a rotatable handle 66 on one side of the upper cover 62. The upper cover 62 has a lid for opening/closing so that, if the condensed water is filled in the drain unit 60 beyond a preset amount, the user may pull out the drawer 42, separate the drain unit 60 from the drawer 42 by using the handle 66, open the lid 64, and throw away the water. Alternatively, a drain pipe or hose (not shown) may be employed to remove condensed water from the drain unit 60 without having to remove the drain unit 60 from its respective chamber.

Though not shown in the drawing, after the condensed water condensed at the air supply unit 22 is collected at an underlying storage unit (not shown), the condensed water is supplied to the drain unit 60 through the drawer via a pipeline by a pump or the like. Accordingly, at the rear end of the drain unit 60, an inlet (not shown) can be formed for inlet of the condensed water supplied through the pipeline. That is, upon mounting the drain unit 60 to the chamber 43 of the drawer 42, and pushing in the drawer 42, the inlet may be connected to the pipeline extended from the air supply unit 22 through the drawer 42. In this case, the guide means may guide the inlet of the drain unit 50 to be connected to the pipeline through the drawer 42 if the user mounts the drain unit 50 to the drawer 42.

Figure 4:
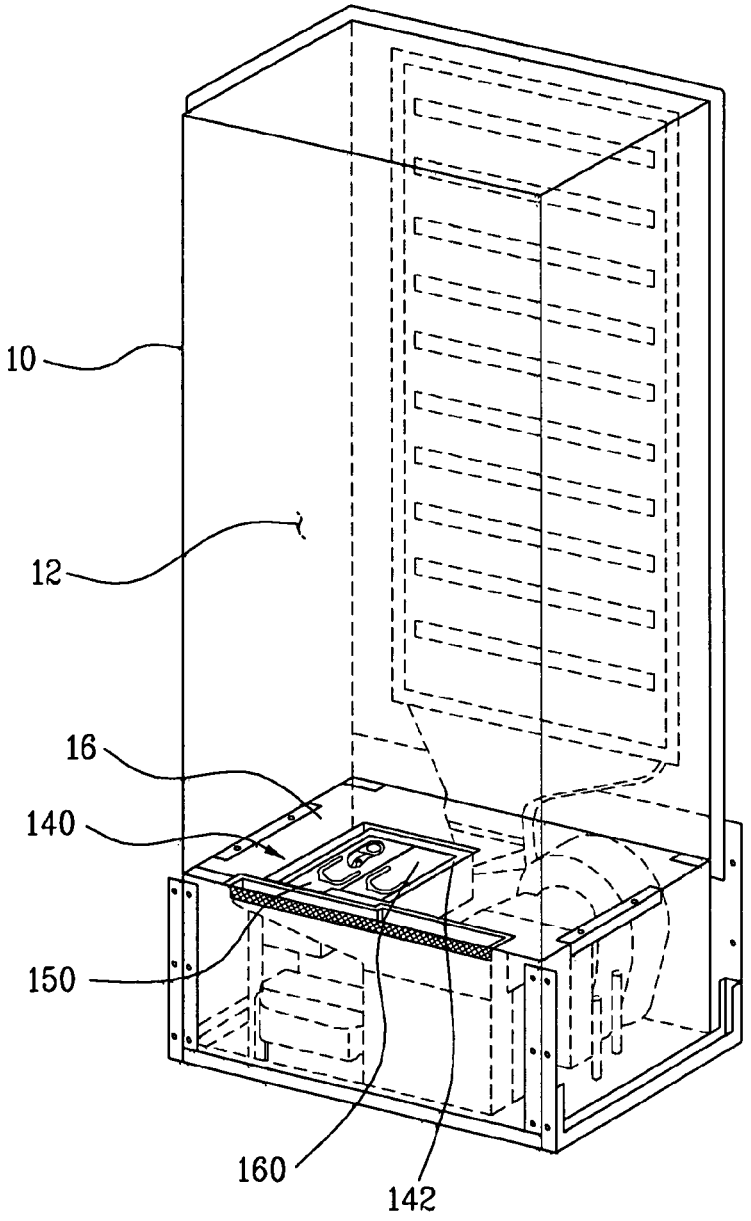
FIG. 4 illustrates a perspective view of the storage module in FIG. 1 in accordance with a second preferred embodiment of the present invention.

FIG. 4 illustrates a perspective view of a water supply unit 150 and a drain unit 160 of the clothes treating apparatus in accordance with a second preferred embodiment of the present invention.

In comparison to the foregoing third embodiment described with reference to FIG. 3, the second embodiment has a difference in that a drawer 142 of a storage module 140 is mounted movable in a vertical direction. The second embodiment will be described focused on the difference.

Referring to FIG. 4, the drawer 142 of the storage module 140 is detachably mounted to a side of the cabinet 10 vertically, preferably on a bottom 16 of the accommodating space 12, i.e., on a top of the mechanism compartment 20. Accordingly, as shown in FIG. 4, the user moves down the drawer 142 vertically to mount the drawer 142 on the bottom 16 of the accommodating space 12, and moves up the drawer 142 vertically, to take the drawer out of the cabinet 10. Though not shown in the drawing, in a case where the drawer 142 is mounted on the bottom 16, it is preferable that a cover (not shown) is provided to make the inside of the drawer 142 invisible.

The mounting of the water supply unit 150 and the drain unit 160 in the drawer 142 of the storage module 140 is similar to the embodiment of FIG. 3, except that, since the drawer moves vertically, it is preferable that a system for connecting the water supply unit 150 and the moisture supply unit 30, and a system for connecting the pipeline extended from the drain unit 160 and the air supply unit 22, are arranged vertically through the drawer 42. Since the systems correspond to the embodiment of the FIG. 3 of which direction is changed from the horizontal direction to the vertical direction, detailed description of which will be omitted.

Figure 5:
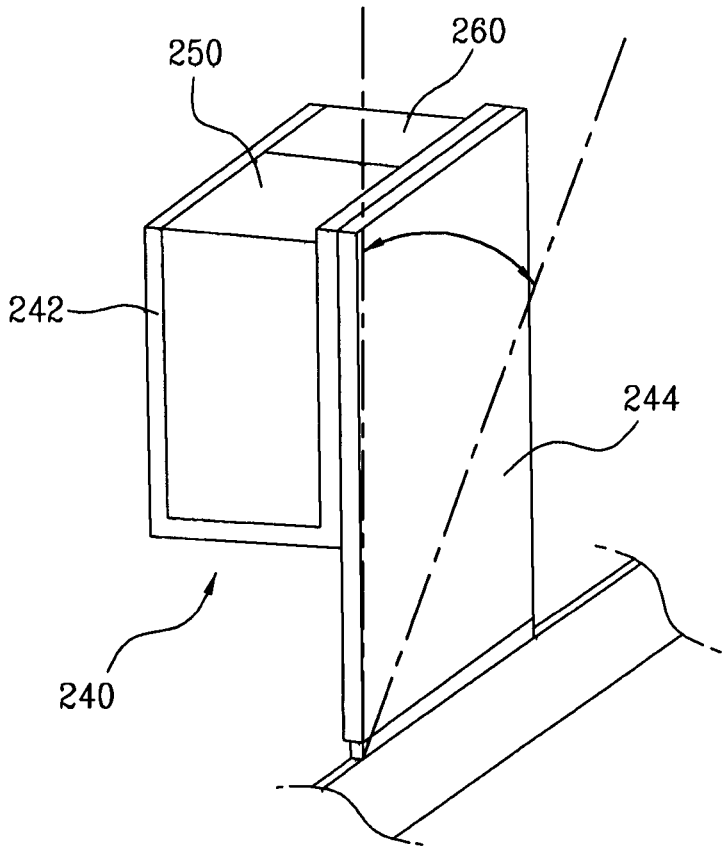
FIG. 5 illustrates a perspective view of the storage module in FIG. 1 in accordance with a third preferred embodiment of the present invention.

FIG. 5 illustrates a perspective view of a water supply unit 250 and a drain unit 260 of the clothes treating apparatus in accordance with a third preferred embodiment of the present invention.

In comparison to the foregoing embodiments, the third embodiment is different in that a drawer 242 of a storage module 240 is rotatably mounted. The third embodiment will be described focused on the difference.

Referring to FIG. 5, the storage module 240 is rotatably mounted to one side of the cabinet 10 (see FIG. 1). In detail, the storage module 240 includes a drawer 242 for holding the water supply unit 250 and the drain unit 260, and a rotatable plate 244 extended from the drawer 242.

The rotatable plate 244 is mounted to one side of the machinery room 244, preferably at a front portion 20 of the mechanism compartment 20 for rotating toward a front when the door 14 (see FIG. 1) is opened. As shown with an arrow in FIG. 5, it is preferable that the rotatable plate 244 is mounted to rotate around a lower end.

Where the drawer 242 is rotatably mounted like the exemplary embodiment of FIG. 5, if the water supply unit 250 is mounted to the chamber of the drawer 242 and then the drawer 242 is rotated to put the drawer 242 into a mounted position, a water outlet (not shown) at a rear end of the water supply unit 250 may be connected to a hose or the like connected to the moisture supply unit 30 through the drawer 242, enabling the supply of water from the water supply unit 250 to the moisture supply unit 30.

The drain unit 260 may have an inlet (not shown) at a rear end for introduction of the condensed water through the pipeline. Therefore, if the drain unit 260 is mounted to the chamber of the drawer 242 and the drawer 242 is rotated to push in the drawer 242, the inlet of the drain unit 260 is connected to the pipeline extended from the air supply unit 22 through the drawer 42.

The operation of the clothes treating apparatus will be described.

Before putting the clothes treating apparatus 100 into operation, the user detaches the water supply unit 50, 150, or 250, fills the water in the water supply unit 50, 150, or 250, and mounts the water supply unit 50, 150, or 250 to the drawer 42, 142, or 242, again. If the drain unit 60, 160 or 260 which collects the condensed water is full, the user may detach the drain unit from the drawer 42, 142, or 242, throw away the condensed water, and remount the drain unit to the drawer. Then, after mounting the drawer 42, 142, or 242 to the mechanism compartment 20, the clothes treating apparatus is put into operation.

Upon putting the clothes treating apparatus into operation, the water is supplied from the water supply unit to the moisture supply unit 30, moisture (e.g. fine particle water dispersion) or steam is generated, and sprayed to the accommodating space 12. According to this, wrinkles are removed from clothes, and inflation as well as sterilizing effect of clothing fibers can also be obtained.

After spray of the moisture or steam for a predetermined time period, dry heated air is supplied from the air supply unit 22. The air supply unit 22 removes the moisture from the air, heats the air, and supplies the air to the accommodating space 12, again. The condensed water is supplied from the air supply unit 22 to the drain unit 60, 160, or 260 through the pipeline.

Once the clothing is dried by the hot air, the supply of hot air is finished, to finish the refresh process.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

As has been described, the clothes treating apparatus of the present invention can supply moisture and dry heated air to the holding space, and is provided with the water supply unit and the drain unit for collecting condensed water formed as the moisture is removed, to permit installation of the clothes treating without being limited by an installation place.

The invention claimed is:

1. A clothes treating apparatus comprising:

a housing having a holding space for clothes;

an air supply unit for generating dry air and supplying the dry air to the holding space;

a moisture supply unit for supplying moisture to the holding space;

a water supply unit adapted to supply water to the moisture supply unit;

a drain unit adapted to collect condensed water from the air supply unit; and at least one storage module provided to the housing, wherein the water supply unit and the drain unit are detachably mounted to the storage module.

2. The clothes treating apparatus as claimed in claim 1, wherein the water supply unit and the drain unit are independently removable from within the storage module.

3. The clothes treating apparatus as claimed in claim 2, wherein the drain unit comprises a drain pipe or hose adapted to drain condensed water from the drain unit.

4. The clothes treating apparatus as claimed in claim 1, wherein the storage module includes a drawer which can be pushed in/pulled out of one side of the housing.

5. The clothes treating apparatus as claimed in claim 4, wherein the drawer can be pushed in/pulled out of one side of the housing in a horizontal direction.

6. The clothes treating apparatus as claimed in claim 4, wherein the drawer can be pushed in/pulled out of one side of the housing in a vertical direction.

7. The clothes treating apparatus as claimed in claim 4, wherein the drawer is rotatably mounted to one side of the housing.

8. The clothes treating apparatus as claimed in claim 4, wherein the drawer includes guide means for guiding movement of the water supply unit and the drain unit when the water supply unit and the drain unit are mounted to the drawer.

9. The clothes treating apparatus as claimed in claim 4, wherein the water supply unit and the drain unit include flow passages formed through the drawer, respectively.

10. The clothes treating apparatus as claimed in claim 1, wherein the storage module includes a drawer which can be pushed in/pulled out of one side of the housing.

11. The clothes treating apparatus as claimed in claim 1, wherein the water supply unit and the drain unit are removable together as a single, integrated unit.

12. A clothes treating apparatus comprising:

a housing having a holding space for holding clothes;

an air supply unit for generating dry air and supplying the dry air to the holding space;

a moisture supply unit for supplying moisture to the holding space; and a storage module having a plurality of chambers each for holding either a water supply unit for supplying water to the moisture supply unit, or a drain unit for collecting condensed water from the air supply unit.

13. The clothes treating apparatus as claimed in claim 12, wherein the storage module includes a drawer which can be pushed in/pulled out of one side of the housing.

14. A clothes treating apparatus comprising:

a housing having a holding space for holding clothes;

an air supply unit for generating dry air and supplying the dry air to the holding space;

a moisture supply unit for supplying moisture to the holding space; and at least one storage module for holding a water supply unit for supplying water to the moisture supply unit, and a drain unit for collecting condensed water from the air supply unit, wherein flow passages of the water supply unit and the drain unit are formed through the storage module, respectively.

15. The clothes treating apparatus as claimed in claim 14, wherein each of the at least one storage module includes a drawer which can be pushed in and pulled out of one side of the housing.

16. The clothes treating apparatus as claimed in claim 14, wherein the water supply unit and the drain unit are detachably mounted to the storage module.

17. The clothes treating apparatus as claimed in claim 14 further comprising:

a first storage module for housing the water supply unit; and a second storage module for housing the drain unit.

* * * * *